US007695320B2

(12) United States Patent
Tsukashima et al.

(10) Patent No.: US 7,695,320 B2
(45) Date of Patent: Apr. 13, 2010

(54) SHIELD SHELL

(75) Inventors: Hiroyuki Tsukashima, Nishikamo-gun (JP); Takamasa Takeuchi, Anjo (JP); Satoshi Tsuruta, Yokkaichi (JP); Kazumoto Konda, Yokkaichi (JP)

(73) Assignees: Toyota Jidosha Kabushiki Kaisha, Toyota (JP); Autonetworks Technologies, Ltd., Mie (JP); Aisin AW Co., Ltd., Anjo (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 217 days.

(21) Appl. No.: 11/794,812

(22) PCT Filed: Jun. 5, 2006

(86) PCT No.: PCT/JP2006/011685

§ 371 (c)(1),
(2), (4) Date: Jul. 6, 2007

(87) PCT Pub. No.: WO2006/132391

PCT Pub. Date: Dec. 14, 2006

(65) Prior Publication Data

US 2009/0130903 A1 May 21, 2009

(30) Foreign Application Priority Data

Jun. 7, 2005 (JP) ..... 2005-166726

(51) Int. Cl.
*H01R 9/03* (2006.01)

(52) U.S. Cl. ..... 439/607.44; 439/607.55

(58) Field of Classification Search ..... 439/610, 439/607.28, 607.41, 607.44, 607.52, 564, 439/573, 607.55, 607.17
See application file for complete search history.

(56) References Cited

U.S. PATENT DOCUMENTS

| | | | | | |
|---|---|---|---|---|---|
| 3,221,290 | A | * | 11/1965 | Stark et al. | 439/877 |
| 4,830,629 | A | * | 5/1989 | Yoshimura | 439/607.41 |
| 5,046,967 | A | * | 9/1991 | Majernik et al. | 439/607.51 |

(Continued)

FOREIGN PATENT DOCUMENTS

| | | |
|---|---|---|
| JP | U-61-090178 | 6/1986 |
| JP | U-63-202079 | 12/1988 |
| JP | A 2002-75557 | 3/2002 |
| JP | AU-2004-327100 | 11/2004 |
| JP | A-2005-026110 | 1/2005 |

OTHER PUBLICATIONS

Japanese Office Action issued Dec. 15, 2009 in Japanese Patent Application No. 2005-166716 (with translation).

*Primary Examiner*—Felix O Figueroa
(74) *Attorney, Agent, or Firm*—Oliff & Berridge PLC

(57) ABSTRACT

The shield shell is formed of a shield shell main body, a shield shell auxiliary member and a fixing member. The shield shell main body is made of die-cast aluminum. The shield shell auxiliary member is formed by pressing a steel plate, and has a surface plated with gold. The fixing member has a ring shape, which is formed by pressing a steel plate. With this configuration, it is possible to provide a shield shell that can be manufactured at a low cost, that can improve reliability of the shielding effect, and that can improve assembling workability of the shielded wire.

5 Claims, 4 Drawing Sheets

U.S. PATENT DOCUMENTS 6,929,512 B2 * 8/2005 Lai ..... 439/607.27
2002/0006743 A1 1/2002 Kanagawa et al.
2002/0157843 A1 10/2002 Fukushima et al.
2003/0221850 A1 12/2003 Mizutani
2004/0057187 A1 3/2004 Kuboshima et al.
2004/0266266 A1 12/2004 Lai

* cited by examiner

SHIELD SHELL

TECHNICAL FIELD

The present invention relates to a structure of a shield shell.

BACKGROUND ART

Conventionally, a plurality of electrical devices are mounted to a hybrid vehicle (HV), an electric vehicle (EV), and a fuel cell vehicle (FCV). In a vehicle mounted with a rotating electrical machine, for example, connection between the electrical devices, like between a battery and an inverter, between the inverter and the rotating electrical machine (motor generator), and between the inverter and an electrical air compressor, are established using a power cable to which a high voltage is applied and through which a large current passes. When connecting the power cable to the electrical device, connectors are generally used. More specifically, the power cable and the electrical device are provided with connectors, which have shapes capable of mating with each other. The respective connectors as a male connector and a female connector have contact points for establishing electrical connection. When the male and female connectors are mated with each other, the contact points are connected to each other to achieve electrical connection (see, e.g., Japanese Patent Laying-Open No. 2002-075557).

FIG. 4 shows in cross section a connection structure between a power cable and an electrical device. A female connector 301 is provided on a casing 303 side. A cable 302 is connected to female connector 301. Cable 302 is coupled to an electrical device, which may be a stator of a motor generator, for example.

A power cable 100 has an insulated wire 101 and a braided conductor 110 covering the periphery of insulated wire 101. Although one insulated wire 101 is illustrated, in the case where power cable 100 is to be connected to a stator of a motor generator or the like, three insulated wires of U-phase cable, V-phase cable and W-phase cable may be used. A rod-shaped electrode 102 bent into an L-shape is connected at a tip end of insulated wire 101, which electrode is sealed with a resin 103 to expose only a tip end thereof. With this resin 103, a cylindrical guide 104 is formed to surround the tip end of rod-shaped electrode 102. Rod-shaped electrode 102, resin 103 and cylindrical guide 104 constitute a male connector 105. When female connector 301 is mated with cylindrical guide 104 of male connector 105, electrical connection is established between male connector 105 and female connector 301.

The exposed portion of male connector 105 of power cable 100 is covered with a shield shell 201 from the standpoint of grounding braided conductor 110 to casing 303 of the device, and also from the standpoint of guiding power cable 100 in a prescribed drawing direction. Shield shell 201 is usually made of die-cast aluminum, since it should be rigid enough to guide power cable 100 in the prescribed drawing direction.

Shield shell 201 has its entire surface plated for the purpose of establishing electrical conduction between braided conductor 110 and casing 303. At the portion of shield shell 201 from which power cable 100 is drawn out, braided conductor 110 is guided to cover the relevant portion, and a ring-shaped member 210 is used to fix braided conductor 110 to shield shell 201 by caulking from the outer peripheral side of braided conductor 110. Shield shell 201 is securely fixed to casing 303 by means of a bolt 202 or the like.

To connect the power cable to the electrical device using the above-described shield shell, it is necessary to prepare a shield shell having a shape corresponding to the vehicle mounting condition (i.e., corresponding to the vehicle type), which would increase the manufacturing cost due to the necessity of integral molding using aluminum, plating of the surface and the like. Further, the braided conductor is secured to the shield shell by caulking, from the standpoint of working efficiency. However, since the shield shell is hard as it is made of die-cast aluminum, it is not possible to sufficiently fix the braided conductor to the shield shell, and thus, an adequate shielding effect cannot be ensured. Furthermore, in recent years, the length of the power cable has become longer in various vehicle types. With the single-piece shield shell as described above, it is necessary to pass the entire length of the power cable through the shield shell, which results in degradation of assembling workability.

DISCLOSURE OF THE INVENTION

The problems to be solved by the present invention regarding a shield shell for use in connecting a shielded wire to an electrical device include: that the manufacturing cost is high; that the braided conductor cannot be fixed to the shield shell satisfactorily; and that the assembling workability of the shielded wire cannot be improved. Thus, an object of the present invention is to provide a shield shell that can be manufactured at a low cost, that can achieve a sufficient shielding effect, and that can improve the assembling workability of the shielded wire.

According to the present invention, there is provided a shield shell that covers a second connector coupled to a tip end of a shielded wire and to be connected to a first connector provided at a casing containing an electrical device mounted to a vehicle. The shielded wire includes an insulated wire having a tip end to which the second connector is coupled, and a braided conductor covering the periphery of the insulated wire. The shield shell covers a part of the second connector that is exposed from the casing and connected with the first connector. The shield shell includes: a shield shell main body including a cylindrical member for passing the insulated wire therethrough, and having one opening end accommodating the second connector therein, and the other opening end provided with a first flange portion protruding radially outward; a shield shell auxiliary member including a cylindrical member for passing the insulated wire therethrough, and having one opening end provided with a second flange portion protruding radially outward and connectable with the first flange portion; and a fixing member fixing the braided conductor to an outer peripheral surface of the cylindrical member of the shield shell auxiliary member in the state where the braided conductor is arranged along the outer peripheral surface of the cylindrical member.

The shield shell according to the present invention has a two-piece structure of the shield shell main body and the shield shell auxiliary member. As such, the function required for the shield shell to guide the shielded wire in a prescribed drawing direction may be held by the shield shell main body, while the primary function of the shield shell to ground the braided conductor of the shielded wire to the casing of the device may be held by the shield shell auxiliary member. As a result, it is possible to differentiate the materials for the shield shell main body and the shield shell auxiliary member, and thus is possible to manufacture the shield shell main body and the shield shell auxiliary member using the materials suitable for the functions required for the respective portions.

This ensures broad options of materials therefore, and thus can reduce the manufacturing cost required for the shield shell. Further, upon attachment of the braided conductor to the shield shell auxiliary member, it is possible to select the most suitable material, which can improve reliability in fixing of the braided conductor to the shield shell, and can ensure a sufficient shielding effect. Furthermore, the shield shell may be configured to have a multiple-part structure, which can improve assembling workability of the shielded wire.

BEST MODES FOR CARRYING OUT THE INVENTION

Figure 1:
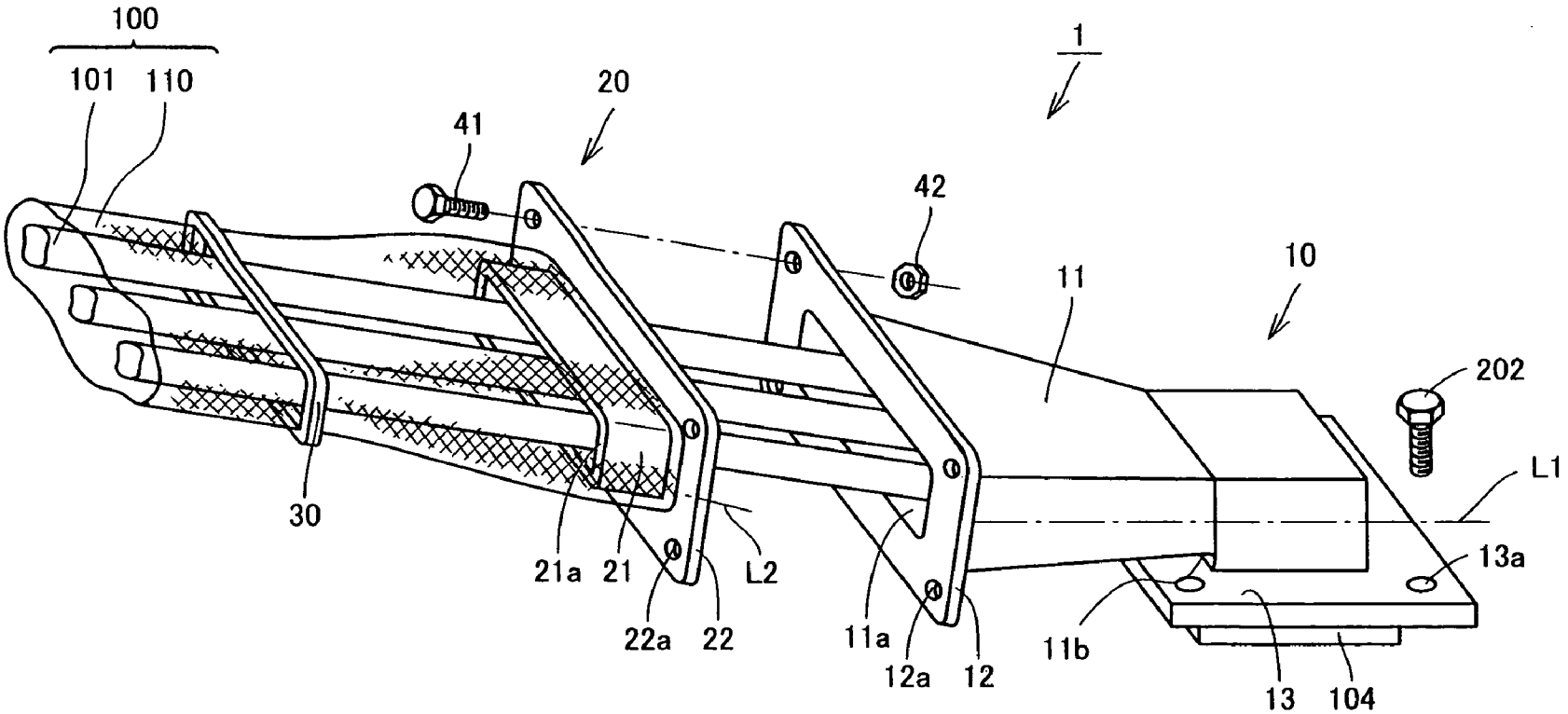
FIG. 1 is an overall exploded perspective view of a structure of a shield shell according to an embodiment of the present invention.

Hereinafter, a structure of the shield shell according to an embodiment of the present invention will be described with reference to the drawings. In the following, the structure of the shield shell based on the present invention will be explained in detail. Meanwhile, the portions of the connectors are denoted with the reference characters identical to those used for the conventional ones, and their labels and functions are also identical. Thus, detailed description thereof will not be repeated.

It is noted that the shield shell of the present invention is not solely applied to a rotating electrical machine using a power cable. For example, it is applicable to an inverter, converter or other electrical devices mounted to a vehicle. Further, the vehicle to which the rotating electrical machine is mounted may be an HV, EV, or FCV mounted with a motor for driving the vehicle, although it is not particularly restricted thereto.

Figure 2:
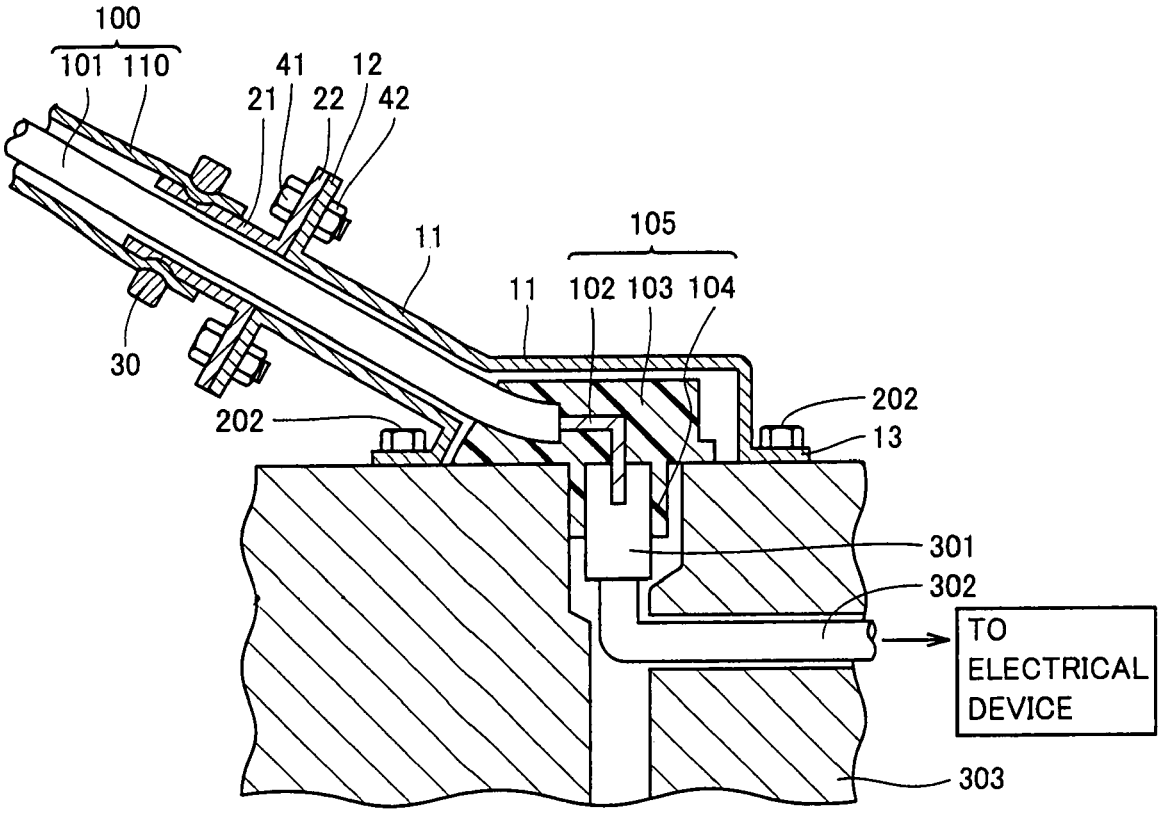
FIG. 2 is a vertical cross sectional view of the structure of the shield shell according to the embodiment of the present invention.

Firstly, a structure of the shield shell 1 according to the present embodiment will be described with reference to FIGS. 1 and 2. FIG. 1 is an overall exploded perspective view of the structure of shield shell 1 of the present embodiment, and FIG. 2 is a vertical cross sectional view of the structure of shield shell 1 of the present embodiment. Shield shell 1 of the present embodiment is provided to cover a male connector 105 serving as a second connector that is coupled to a tip end of a power cable 100, which connector is to be connected to a female connector 301 serving as a first connector provided at a casing 303 containing an electrical device mounted to a vehicle. More specifically, shield shell 1 covers a part of male connector 105 that is exposed from casing 303 and connected with female connector 301.

Shield shell 1 is formed of a shield shell main body 10, a shield shell auxiliary member 20, and a fixing member 30. Firstly, shield shell main body 10 has a cylindrical member 11 for passing an insulated wire 101 of power cable 100 therethrough. Shield shell main body 10 has one opening end at which male connector 105 is arranged, and the other opening end at which a first flange portion 12 is provided to protrude radially outward.

Inside cylindrical member 11, a conduit 11*a* is provided, and a bent region 11*b* is formed to guide power cable 100 in a prescribed drawing direction. First flange portion 12 is provided with a plurality of bolt holes 12*a* for connection with a second flange portion 22, which will be described later. At the one opening end of cylindrical member 11, a third flange portion 13 is also provided to protrude radially outward. Bolt holes 13*a* provided at third flange portion 13 are used to securely fix shield shell main body 10 to casing 303 by means of bolts 202.

Shield shell main body 10 is made of die-cast aluminum, since it requires rigidity in itself so as to withstand the reaction force primarily when power cable 100 is bent.

Shield shell auxiliary member 20 includes a cylindrical member 21 as well, through which insulated wire 101 is passed. Shield shell auxiliary member 20 has one opening end provided with a second flange portion 22 protruding radially outward, which flange can be coupled to first flange portion 12 of shield shell main body 10. Second flange portion 22 is provided with a plurality of bolt holes 22*a* at positions corresponding to bolt holes 12*a*provided at first flange portion 12. Shield shell auxiliary member 20 is formed by pressing a steel plate, and has a surface plated with gold 20*p*, primarily from the standpoint of ensuring electrical conduction with insulated wire 101.

Fixing member 30 has a ring shape and surrounds cylindrical member 21 from the outside. Fixing member 30 is formed by pressing a steel plate, since it is to be caulked to securely fix insulated wire 101 to cylindrical member 21.

In assembling power cable 100 to casing 303 using shield shell 1 having the configuration described above, firstly, insulated wire 101 having male connector 105 provided at its tip end is passed through shield shell main body 10, and then through shield shell auxiliary member 20 and fixing member 30.

Figure 3:
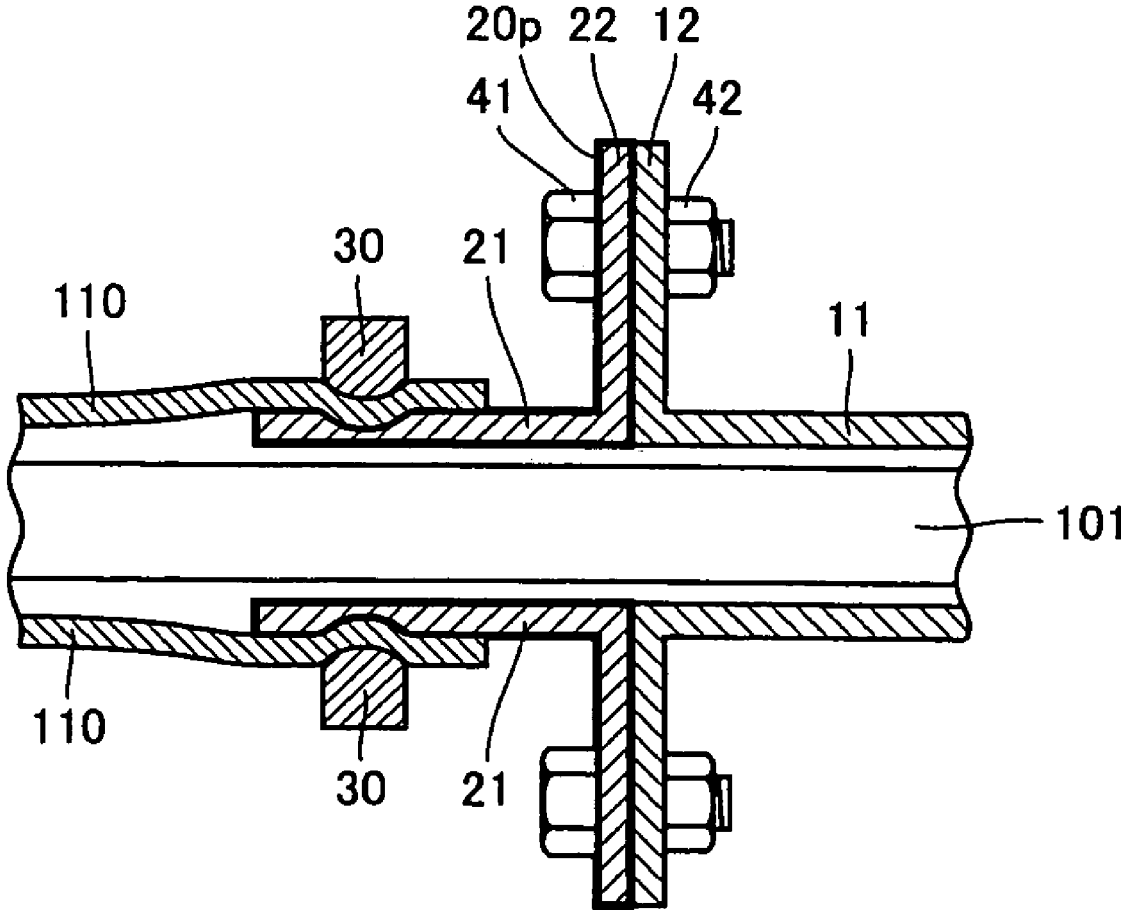
FIG. 3 is a partially enlarged cross sectional view showing the coupled state of a shield shell auxiliary member and a braided conductor according to the embodiment of the present invention.
Figure 4:
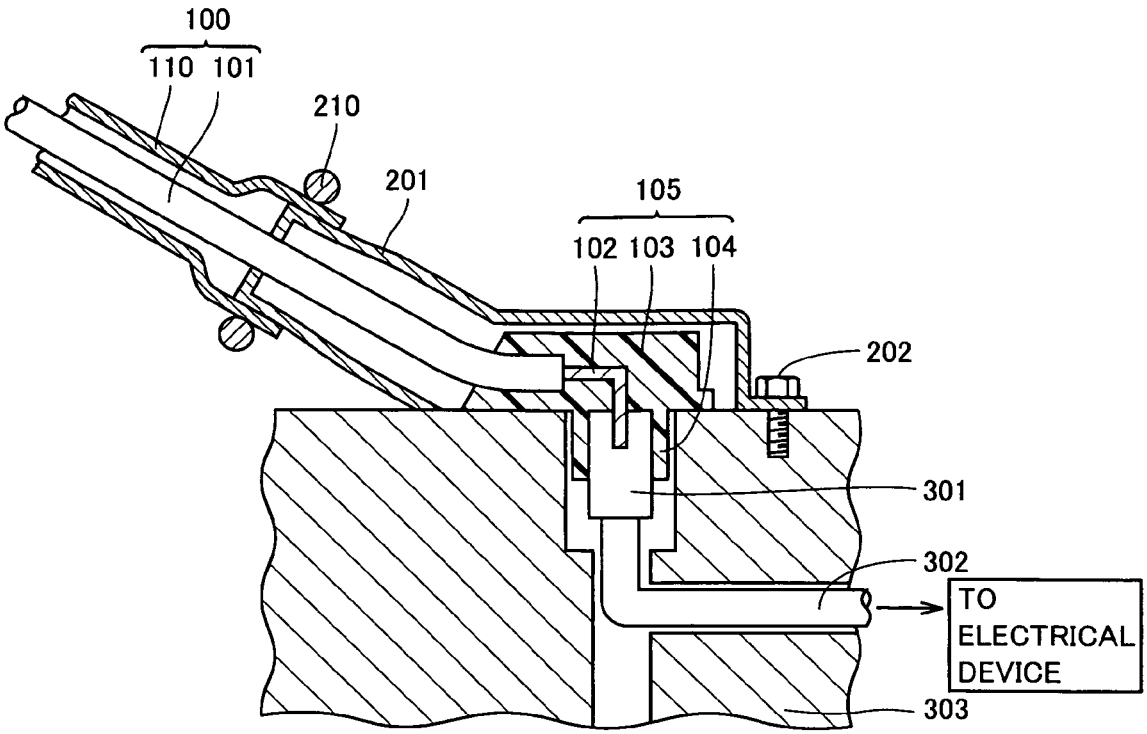
FIG.4 PRIOR ART
FIG. 4 is a vertical cross sectional view of a structure of a shield shell.

Next, braided conductor 110 is arranged to cover the outer peripheral surface of cylindrical member 21 of shield shell auxiliary member 20, and fixing member 30 is used to fix braided conductor 110 to the outer peripheral surface of cylindrical member 21 by caulking from the outer peripheral side of braided conductor 110. At this time, braided conductor 110 and cylindrical member 21, which is formed of steel plate, are deformed inward, as shown by the enlarged cross sectional view in FIG. 3. This provides a sufficiently large contact area between braided conductor 110 and cylindrical member 21, and ensures reliability in fixing of braided conductor 110 to cylindrical member 21 and also ensures electrical conduction therebetween. It is noted that the shape of fixing member 30 is not limited to the ring shape. A fixing member of a belt shape or a wire shape may also be used as long as it can securely fix braided conductor 110 to cylindrical member 21.

Thereafter, bolt holes 12*a* of first flange portion 12 are aligned with corresponding bolt holes 22*a* of second flange portion 22, and bolts 41 and nuts 42 are used to fasten shield shell auxiliary member 20 to shield shell main body 10.

As described above, shield shell 1 of the present embodiment has a two-piece structure of shield shell main body 10 and shield shell auxiliary member 20. As such, the function required for shield shell 1 to guide power cable 100 in a prescribed drawing direction may be held by shield shell main body 10, while the primary function of shield shell 1 to ground braided conductor 110 of power cable 100 to casing 303 of the device may be held by shield shell auxiliary member 20.

As a result, it is possible to differentiate the materials for shield shell main body 10 and shield shell auxiliary member 20, like die-cast aluminum for shield shell main body 10 and steel plate for shield shell auxiliary member 20, for example. Accordingly, it is possible to manufacture shield shell main body 10 and shield shell auxiliary member 20 by using the materials suitable for the functions required for the respective portions. This ensures broad options of materials therefor, and thus can reduce the manufacturing cost required for shield shell 1. Further, upon attachment of braided conductor 110 to shield shell auxiliary member 20, braided conductor 110 can be dented toward shield shell auxiliary member 20, which can improve reliability in fixing of braided conductor 110 to shield shell 1, and can ensure a sufficient shielding effect.

Further, shield shell 1 may be configured to have a multiple-part structure so as to improve assembling workability of the power cable. For example, referring to FIG. 1, shield shell main body 10 and shield shell auxiliary member 20 may be divided vertically into two parts along lines L1 and L2, respectively, so that they can sandwich insulated wire 101 from the top and the bottom. This can eliminate the need to pass insulated wire 101 through shield shell main body 10 and shield shell auxiliary member 20, so that the assembling workability of the power cable further improves.

It is noted that the shield shell of the present invention is not solely applied to a rotating electrical machine using a power cable. For example, it is applicable to an inverter, converter or other electrical devices mounted to a vehicle. Further, the vehicle to which the rotating electrical machine is mounted may be an HV, EV, or FCV mounted with a motor for driving the vehicle, although it is not particularly restricted thereto.

Further, although rod-shaped electrode 102 bent into an L-shape is connected to the tip end of insulated wire 101, not limited to the L-shape, a straight rod-shaped electrode or a curved rod-shaped electrode may also be used.

Still further, although the case of adopting connection between female connector 301 that is the first connector and male connector 105 that is the second connector has been described above, not limited to the connection using connectors, a connection structure using bolts, or other connection structures may also be adopted.

Therefore, it should be understood that the embodiments disclosed herein are illustrative and non-restrictive in every respect. The scope of the present invention is defined by the terms of the claims, rather than the description above, and is intended to include any modifications within the scope and meaning equivalent to the terms of the claims.

The invention claimed is:

1. A shield shell covering a second connector coupled to a tip end of a shielded wire and to be connected to a first connector provided at a casing containing an electrical device mounted to a vehicle, said shielded wire including an insulated wire having a tip end to which said second connector is coupled and a braided conductor covering the periphery of said insulated wire, the shield shell covering a part of said second connector exposed from said casing and connected with said first connector, the shield shell comprising:

a shield shell main body including a cylindrical member for passing the insulated wire therethrough, and having one opening end accommodating said second connector therein, and the other opening end provided with a first flange portion protruding radially outward;

a shield shell auxiliary member including a cylindrical member for passing the insulated wire therethrough, and having one opening end provided with a second flange portion protruding radially outward and connectable with said first flange portion; and a fixing member fixing said braided conductor to an outer peripheral surface of said cylindrical member of said shield shell auxiliary member in the state where said braided conductor is arranged along the outer peripheral surface of said cylindrical member, wherein the electrical device mounted to the vehicle is applied with a high voltage and passes a large current therethrough, and a third flange portion is provided on the one opening end of the shield shell main body, the third flange protruding radially outward and fixing the shield shell main body to the electrical device.

2. The shield shell according to claim 1, wherein said shield shell auxiliary member has a plated surface.

3. The shield shell according to claim 1, wherein said shield shell main body has a bent portion, and said second connector is an L-shaped connector.

4. The shield shell according to claim 1, wherein said shielded wire is a power cable that is applied with a high voltage and passes a large current therethrough upon connection between electrical devices mounted to the vehicle.

5. A shield shell covering a second connector coupled to a tip end of a shielded wire and to be connected to a first connector provided at a casing containing an electrical device mounted to a vehicle, said shielded wire including an insulated wire having a tip end to which said second connector is coupled and a braided conductor covering the periphery of said insulated wire, the shield shell covering a part of said second connector exposed from said casing and connected with said first connector, the shield shell comprising:

a shield shell main body including a cylindrical member for passing the insulated wire therethrough, and having one opening end accommodating said second connector therein, and the other opening end provided with a first flange portion protruding radially outward;

a shield shell auxiliary member including a cylindrical member for passing the insulated wire therethrough, and having one opening end provided with a second flange portion protruding radially outward and connectable with said first flange portion; and a fixing member fixing said braided conductor to an outer peripheral surface of said cylindrical member of said shield shell auxiliary member in the state where said braided conductor is arranged along the outer peripheral surface of said cylindrical member, wherein the electrical device mounted to the vehicle is applied with a high voltage and passes a large current therethrough, a third flange portion is provided on the one opening end of the shield shell main body, the third flange fixing the shield shell main body to the electrical device, and said shield shell auxiliary member is made of a material softer than a material of said shield shell main body.

* * * * *

UNITED STATES PATENT AND TRADEMARK OFFICE

CERTIFICATE OF CORRECTION

PATENT NO. : 7,695,320 B2
APPLICATION NO. : 11/794812
DATED : April 13, 2010
INVENTOR(S) : Hiroyuki Tsukashima et al.

It is certified that error appears in the above-identified patent and that said Letters Patent is hereby corrected as shown below:

Title page delete the following:

Item "(86) PCT No.: PCT/JP2006/011685 and Replace with:

(86) PCT No.: PCT/JP2006/311685

Please delete the following:

"OTHER PUBLICATIONS

Japanese Office Action issued Dec. 15, 2009 in Japanese Patent Application No. 2005-166716 (with translation)."

and Replace with:

OTHER PUBLICATIONS

Japanese Office Action issued Dec. 15, 2009 in Japanese Patent Application No. 2005-166726 (with translation).

Signed and Sealed this

Thirty-first Day of August, 2010

David J. Kappos

David J. Kappos
*Director of the United States Patent and Trademark Office*